US007261407B2

(12) United States Patent
Nishikawa et al.

(10) Patent No.: US 7,261,407 B2
(45) Date of Patent: Aug. 28, 2007

(54) PROCESS AND PRINTING APPARATUS FOR INK JET PRINTING ON CLOTH USING ULTRAVIOLET RAY CURABLE INK

(75) Inventors: Tomoyuki Nishikawa, Fukui (JP); Yoshikatsu Itoh, Fukui (JP)

(73) Assignee: Seiren Co., Ltd., Fukui-ken (JP)

( * ) Notice: Subject to any disclaimer, the term of this patent is extended or adjusted under 35 U.S.C. 154(b) by 291 days.

(21) Appl. No.: 10/820,306

(22) Filed: Apr. 7, 2004

(65) Prior Publication Data

US 2004/0201660 A1 Oct. 14, 2004

(30) Foreign Application Priority Data

Apr. 8, 2003 (JP) ..... 2003-104235

(51) Int. Cl.
*B41J 2/01* (2006.01)

(52) U.S. Cl. ..... 347/102; 347/101; 347/100

(58) Field of Classification Search ..... 347/100, 347/95, 96, 101, 102; 106/31.6, 31.13, 31.27; 523/160; 428/195, 32.1
See application file for complete search history.

(56) References Cited

U.S. PATENT DOCUMENTS 5,764,263 A * 6/1998 Lin ..... 347/102
5,972,545 A * 10/1999 Eid et al. ..... 430/7
6,126,281 A * 10/2000 Shimoda et al. ..... 347/101
6,145,979 A * 11/2000 Caiger et al. ..... 347/102
6,164,850 A * 12/2000 Speakman ..... 347/107
6,863,392 B2 * 3/2005 Shimomura et al. ..... 347/100
2003/0021961 A1 * 1/2003 Ylitalo et al. ..... 428/195
2004/0153204 A1 * 8/2004 Blanco ..... 700/207
2004/0189772 A1 * 9/2004 Arai ..... 347/102

FOREIGN PATENT DOCUMENTS

JP S59-190885 10/1984
JP 8-150707 6/1996
JP H11-321083 11/1999
JP 2000-117960 4/2000

OTHER PUBLICATIONS

Derwent Abstract of JP-A-59-190885.
Derwent Abstract of JP-A-2000-117960.
Derwent Abstract of JP-A-11-321083.
Derwent Abstract of JP-A-8-150707.

* cited by examiner

*Primary Examiner*—Manish S. Shah
(74) *Attorney, Agent, or Firm*—Ware, Fressola, Van Der Sluys & Adolphson LLP

(57) ABSTRACT

The present invention aims to provide a process for ink jet printing on cloth, in which the pre-treatment step can be omitted and by which printed matter having excellent design, wherein the image is unblurred and has high optical density, can be obtained. Specifically, the present invention relates to a process for ink jet printing on cloth using ultraviolet ray curable ink, which includes the steps of applying a transparent ultraviolet ray curable ink and then curing by ultraviolet rays, and thereafter applying a ultraviolet ray curable ink containing a coloring component to form an image.

2 Claims, 4 Drawing Sheets

1

3
2

3
4

1

3
2

3
4

PROCESS AND PRINTING APPARATUS FOR INK JET PRINTING ON CLOTH USING ULTRAVIOLET RAY CURABLE INK

CROSS REFERENCE TO RELATED APPLICATION

This application claims priority to Japanese Patent Application No. 2003-104235 filed on Apr. 8, 2003.

BACKGROUND OF THE INVENTION

The present invention relates a process for ink jet printing on cloth using ultraviolet ray curable ink, more specifically a process for ink jet printing and a printing apparatus, by which an image, which is unblurred and has high optical density, can be obtained and design can be imparted to the printed matter obtained thereby.

In recent years, various types of printers for computer output are becoming widely used. Of these, an ink jet printer is excellent in silence, cost and image quality and particularly, can reproduce full color images in high quality. Because an ink jet printer has excellent properties that other types of printers lack, many studies are being conducted regarding the ink jet, printing method using paper as a recording medium.

Among the ink jet printing methods, the ink jet printing method using ultraviolet ray curable ink is attracting attention. According to this method, the ink can be cured by exposing ultraviolet rays immediately after the ink is discharged from the head. Therefore, there is the advantage that durability of the applied ink is excellent. However, after the ultraviolet ray curable ink is applied, some time passes until ultraviolet rays are exposed and as a result, even in the case that ultraviolet rays are immediately exposed, bleeding of the ink cannot be inhibited in some cases depending on the recording medium.

Consequently, the method of forming an ink-receiving layer to improve ink absorbency is being considered (see for example JP-A-59-190885 and JP-A-11-321083).

However, by forming an ink-receiving layer, another step is increased in the preparation process and the advantage of being able to prepare in a small lot in a short period of time is lost.

Also, when the contact angle of the recording medium surface to deionized water satisfies a specific condition and the volume of the applied ink and the volume of ink that the recording medium can absorb satisfy a specific relationship, an ink layer having favorable wettability can be obtained without forming the above ink-receiving layer and favorable ink jet printing becomes possible (see for example JP-A-2000-117960). However, this invention is directed to a film having favorable wet properties and bleeding cannot be completely prevented when the recording medium is changed to cloth.

Furthermore, disclosed is the method of forming an ink receiving layer by applying an ultraviolet ray curable composition and curing with ultraviolet rays and then applying the ink, using an ink jet printing apparatus having a composition in which a head for the liquid composition, an ultraviolet ray exposing means and an ink head are lined in this order along the traveling direction of the recording medium (see for example JP-A-8-150707). However, this invention is directed mainly to acrylic boards and not to cloth and therefore bleeding cannot be completely prevented when the recording medium is changed to cloth. Also, because dye ink or pigment ink is used in this ink jet printing method, a long period of time is necessary to dry and furthermore, because the ink jet printing apparatus does not have a heating means, viscosity of the ink is difficult to control. In addition, because the composition contains water and a volatile solvent, the composition may foam when cured by ultraviolet rays, impairing appearance and quickening deterioration of the cured substance.

On the other hand, sufficient studies regarding recording mediums have not been conducted. Particularly, with respect to cloth which is used in the present invention, bleeding and density when printing are problems due to the special properties of cloth and a method for solving the above problems has not yet been achieved in the prior art.

SUMMARY OF THE INVENTION

The present invention aims to provide a process for ink jet printing on cloth, in which the pre-treatment step can be omitted and by which printed matter having excellent design, wherein the image is unblurred and has high optical density, can be obtained.

That is, the present invention relates to a process for ink jet printing on cloth using ultraviolet ray curable ink, which comprises the steps of applying a transparent ultraviolet ray curable ink and then curing by ultraviolet rays, and thereafter applying a ultraviolet ray curable ink containing a coloring component to form an image.

The present invention also relates to a process for ink jet printing on cloth using ultraviolet ray curable ink, which comprises the steps of forming a three-dimensional pattern by repeating the step of applying a transparent ultraviolet ray curable ink and then curing by ultraviolet rays, and applying a ultraviolet ray curable ink containing a coloring component to form a three-dimensional image.

The transparent ultraviolet ray curable ink and the ultraviolet ray curable ink containing a coloring component preferably comprise a reactive oligomer, a reactive diluent and a photoinitiator; and the reactive oligomer is preferably contained in an amount of 1 to 70% by weight in the transparent ultraviolet ray curable ink and in an amount of 1 to 60% by weight in the ultraviolet ray curable ink containing a coloring component.

The transparent ultraviolet ray curable ink and the ultraviolet ray curable ink containing a coloring component are preferably heated by a heating means and then discharged.

The present invention also relates to an ink jet printing apparatus equipped with a two-stage ink head having an ultraviolet ray exposing means and a transparent ink head in the front head and an ultraviolet ray exposing means and ultraviolet ray curable ink heads of various colors in the rear head.

The present invention also relates to an ink jet printing apparatus equipped with a linear ink head having a transparent ink head, an ultraviolet ray exposing means and ultraviolet ray curable ink heads of various colors in a straight line.

DETAILED DESCRIPTION

The present invention relates to a process for ink jet printing on cloth using ultraviolet ray curable ink, in which a transparent ultraviolet ray curable ink (hereinafter referred to as transparent ink) is applied to cloth which is the recording medium and then cured by ultraviolet rays and thereafter a ultraviolet ray curable ink containing a coloring component (hereinafter referred to as color ink) is applied and then cured by ultraviolet rays to form an image.

In the present invention, cloth is used as the recording medium. Cloth is superior in durability and texture, compared to paper, and so cloth printed by the process of the present invention can be used for clothing, interior material, sheet material, cloth signs, tent fabric and other industrial material.

The cloth is not particularly limited but specific examples are knit fabric, woven fabric, non-woven fabric and plush fabric/napped fabric. Examples of the woven fabric are plain weave fabric, twill fabric and satin fabric. Examples of the knit fabric are weft fabric such as plain stitch, rib stitch and purl stitch and warp fabric such as single tricot stitch, single code stitch and single atlas stitch.

Examples of the material that form the above fabric are various fibers such as inorganic fibers including metal fiber, glass fiber, rock fiber and slag fiber; regenerated fiber including rayon; semi-synthetic fiber including acetate and triacetate; synthetic fiber including polyamide, polyester, polyvinyl chloride, polyvinylidene chloride, polyacrylonitrile, polyvinyl alcohol, polyurethane, polyethylene, polypropylene and polyethylene fluoride; natural fiber including cotton, hemp, silk and wool; and biodegradable fiber using lactic acid or corn as a raw material. These may be used alone or in a combination of two or more kinds.

Of these, in view of durability and adhesion with ultraviolet ray curable ink, synthetic fiber is preferable and particularly, polyester, which has versatility and strength, is preferable.

Figure 5:
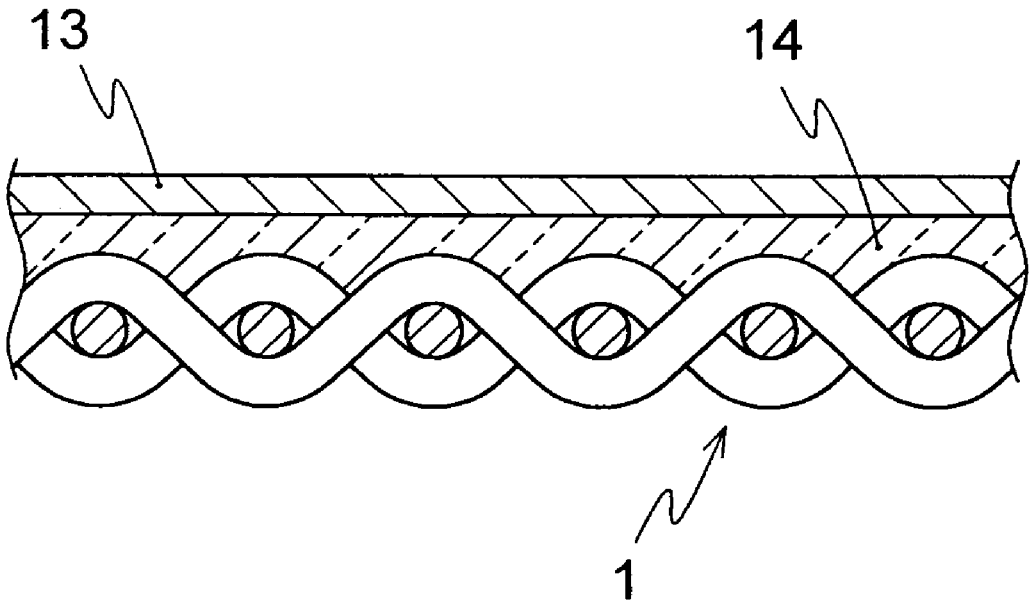
FIG. 5 is a cross sectional view of the printed matter when woven fabric is used as the recording medium.

Usually, when cloth is colored, unevenness of the surface causes diffuse reflection of light and as a result, the density of color on the cloth surface appears light. However, in the present invention, as indicated in FIG. 5, by applying transparent ink to cloth 1 and curing with ultraviolet rays to form transparent ink layer 14, the cloth surface can be made smooth. By applying color ink thereon, diffuse reflection can be prevented and printed images of high optical density can be obtained. Also, by applying color ink after applying transparent ink, bleeding can be prevented.

At first, when transparent ink is applied to the cloth, the transparent ink bleeds but because the ink is transparent, bleeding is not a problem. Also, because a transparent ink layer is formed between the cloth and the color ink, the transparent ink layer functions as a base. Consequently, bleeding, which occurs when the color ink is applied, can be prevented. In light of the above, the transparent ink is preferably transparent and colorless, but can be the same color as the cloth or a color lighter than the cloth. Also, in order to obtain these effects, the amount of the transparent ink that is applied is preferably 5 to 100 $g/m^2$. When the amount is less than 5 $g/m^2$, the effect of preventing bleeding is not exhibited and when the amount is more than 100 $g/m^2$, the texture of the cloth become poor and the properties of the cloth tend to be lost.

According to the ink jet printing method of the present invention, a three-dimensional pattern having excellent design can be formed.

A three-dimensional pattern can be formed by repeating the steps of applying transparent ink along the three-dimensional shape and then exposing with ultraviolet rays several times. Specifically, a three-dimensional shape is formed by applying very little transparent ink to the depressions and repeatedly applying transparent ink to the protrusions. Then, by applying color ink along the three-dimensional shape or to a pattern apart from the three-dimensional shape, a three-dimensional image having excellent design can be formed.

Also, in the process of the present invention, the cloth does not to be pre-treated but when necessary, the cloth can be subjected to pre-treatment such as surface treatment in advance. Specific examples of the surface treatment method are corona treatment, plasma treatment and alkali treatment.

The transparent ink and color ink are described below.

The ultraviolet ray curable ink used in the present invention basically comprises a reactive oligomer, a reactive diluent and a photoinitiator. Herein, an oligomer refers to a polymer in which a monomer unit is repeated approximately two to a few dozen times. The reason why an oligomer, not a monomer or polymer, is used in the present invention is because with a monomer, the hardness and adhesiveness of the obtained cured film is poor and with a polymer, the viscosity becomes high and discharge stability of the ink becomes poor. Also, with a polymer, polymerization cannot be conducted further by ultraviolet rays.

A reactive oligomer refers to an oligomer having a reactive functional group. Examples of the reactive functional group are an acrylic functional group and an epoxy functional group. Of these, an acrylic functional group is preferable from the viewpoint that an acrylic functional group is versatile and various types of resins can be obtained therefrom.

The number of reactive functional groups in a molecule of the reactive oilgomer is preferably 2 to 4, more preferably 2. When the number of reactive functional groups is more than 4, crosslinked points increase in the cured film and the obtained cured film becomes hard but at the same time also fragile. As a result, adhesiveness tends to become poor.

Examples of the reactive oligomer are urethane acrylate, polyester acrylate, epoxy acrylate, silicon acrylate and polybutadiene acrylate. These can be used alone or in a combination of two or more kinds.

Of these, urethane acrylate and polyester acrylate are preferable from the viewpoint that hardness, toughness, adhesiveness and weatherability are excellent.

A reactive diluent refers to a monomer having a reactive functional group and is used to lower the viscosity of the ultraviolet ray curable ink and to maintain discharge stability. Examples of the reactive functional group are the same as those of the reactive oligomer.

Examples of the reactive diluent are hexafunctional compounds such as dipentaerythritol hexaacrylate and modifications thereof; pentafunctional compounds such as dipentaerythritol hydroxypentaacrylate; tetrafunctional compounds such as pentaditrimethylolpropane tetraacrylate and pentaerythritol tetraacrylate; trifunctional compounds such as trimethylolpropane triacrylate, pentaerythritol triacrylate, tris(2-hydroxyethyl)isocyanurate triacrylate and glyceril triacrylate; difunctional compounds such as hydroxypivalic acid neopenthylglycol diacrylate, polytetramethyleneglycol diacrylate, trimethylolpropane acrylic acid benzoic acid ester, diethyleneglycol diacrylate, triethyleneglycol diacrylate, tetraethyleneglycol diacrylate, polyethyleneglycol (200) diacrylate, polyethyleneglycol (400) diacrylate, polyethyleneglycol (600) diacrylate, polyethyleneglycol (1000) diacrylate, polypropyleneglycol (400) diacrylate, polypropyleneglycol (700) diacrylate, neopentylglycol diacrylate, 1,3-butanediol diacrylate, 1,4-butanediol diacrylate, 1,6-hexanediol diacrylate, 1,9-nonanediol diacrylate, dimethylol-tricyclodecane diacrylate and bisphenol A diacrylate; and monofunctional compounds such as caprolactone acrylate, tridecyl acrylate, isodecyl acrylate, isooctyl acrylate, isomiristyl acrylate, isostearyl acrylate, 2-ethylhexyl-diglycol acrylate, 2-hydroxybutyl acrylate, 2-acryloyloxyethyl hexahydrophthalic acid, neopentylglycol acrylic acid benzoic acid ester, isoamylacrylate, lauryl acrylate, stearyl acrylate, buthoxyethyl acrylate, ethoxydiethyleneglycol acrylate, methoxy-triethyleneglycol acrylate, methoxy-polyethyleneglycol acrylate, methoxy-dipropyleneglycol acrylate, phenoxyethyl acrylate, phenoxypolyethyleneglycol acrylate, nonylphenol acrylate, tetrahydrofurfuryl acrylate, isobonyl acrylate, 2-hydroxyethyl acrylate, 2-hydroxypropyl acrylate, 2-hydroxy-3-phenoxypropyl acrylate, 2-acryloyloxyethyl succinic acid, 2-acryloyloxyethylphthalic acid and 2-acryloyloxyethyl-2-hydroxyethylphthalic acid. Furthermore, the reactive diluent may be a reactive diluent obtained by bonding a phosphorous compound or fluorine with the above. Also, the reactive diluent can be modified by ethylene oxide or propylene oxide in order to reduce skin irritation. These may be used alone or in a combination of two or more kinds.

The number of reactive functional groups in a molecule of the reactive diluent is preferably 2 to 4, more preferably 2. When the number of reactive functional groups is more than 4, crosslinked points increase in the cured film and so the obtained cured film becomes hard but at the same time also fragile. As a result, adhesiveness tends to become poor.

Examples of the photoinitiator are benzoin compounds, thioxanthone compounds, benzophenone compounds, ketal compounds and acetophenone compounds. These may be used alone or in a combination of two or more kinds.

The transparent ink used in the present invention becomes the base for color ink and therefore is preferably excellent in adhesion with cloth. Specifically, the transparent ink preferably contains 1 to 40% by weight, more preferably 2 to 20% by weight, of the reactive oligomer. When the amount is less than 1% by weight, adhesiveness is poor. When the amount is more than 40% by weight, adhesiveness is improved but the viscosity of the ink becomes too high and stability when discharging from the ink jet head becomes poor.

However, when the transparent ink is heated, the viscosity decreases along with activation of molecules in the ink and the amount of the reactive oligomer can be increased. Consequently, adhesion with the cloth and color ink tends to improve. When the transparent ink is heated, the reactive oligomer is preferably added in an amount of 1 to 70% by weight, more preferably 2 to 50% by weight. When the amount is more than 70% by weight, the viscosity of the ink becomes too high and stability when discharging from the ink jet head tends to become poor.

The transparent ink of the present invention preferably contains 10 to 90% by weight, more preferably 20 to 80% by weight, of the reactive diluent. When the amount is less than 10% by weight, the viscosity of the ink may not decrease enough. When the amount is more than 90% by weight, adhesiveness and flexibility of the cured film tend to be insufficient.

The transparent ink of the present invention preferably contains 1 to 10% by weight, more preferably 2 to 6% by weight, of a photoinitiator. When the amount is less than 1% by weight, the ultraviolet ray curable ink may not be cured and when the amount is more than 10% by weight, unreacted substances of the photoinitiator remain in the cured film. When subjected to more light from the sun or fluorescent lights, the unreacted residue reacts with the cured film and the cured film tends to become damaged.

The color ink used in the present invention is an ultraviolet ray curable ink containing a coloring component. The basic composition is not particularly limited as long as the composition is the same as that of the transparent ink and the color ink can be obtained by merely adding a coloring component to the transparent ink. By using color ink having the same basic composition as transparent ink, adhesion with transparent ink is improved. Furthermore, because the color ink can be exposed to ultraviolet rays and cured immediately after being discharged from the head, durability of the applied ink is excellent and also bleeding of the ink can be prevented.

The color ink of the present invention preferably contains the reactive oligomer in an amount of 1 to 30% by weight, more preferably 2 to 15% by weight. When the amount is less than 1% by weight, adhesion with the transparent ink tends to become poor. When the amount is more than 30% by weight, adhesion with the transparent ink is improved but because pigment is contained in the color ink, the viscosity of the ink becomes high and stability when discharging from the ink jet head tends to become poor.

Also, as in the case of transparent ink, when the color ink is heated, the reactive oligomer is preferably contained in an amount of 1 to 60% by weight, more preferably 2 to 40% by weight. When the amount is more than 60% by weight, the viscosity of ink becomes too high and stability when discharging from the ink jet head tends to become poor.

The amount of the reactive diluent and the photoinitiator is the same as the amount in the transparent ink.

Both pigment and dye can be used as the coloring agent used in the color ink. When weatherability is desired in the printed matter, pigment is preferably used and when sharpness is desired in the printed matter, dye is preferably used. Any pigment or dye, regardless of whether the pigment or dye is organic or inorganic, can be selected accordingly.

Examples of organic pigment are nitroso pigments, dying lake pigments, azo pigments, phthalocyanine pigments, anthraquinone pigments, perylene pigments, quinacridone pigments, dioxazine pigments, isoindorin pigments, quinophthalone pigments, azomethine pigments and pyrrolopyrrole pigments.

Examples of inorganic pigment are oxides, hydroxides, sulfides, ferrocyanides, chromates, carbonates, sulfates, silicates and phosphates of metal, carbons (carbon black) and metal powders. Mixtures and composites thereof are also included.

Examples of dye are oil-soluble dye, dispersion dye, acidic dye, reactive dye, cationic dye and direct dye such as azo dye, anthraquinone dye, indigoide dye, phthalocyanine dye, carbonium dye, quinoneimine dye, methine dye, nitro dye, nitroso dye, thiazol dye, quinoline dye, lactone dye and hydroxyketone dye.

The amount of the pigment or dye is preferably 0.05 to 20% by weight of the color ink. When the amount is less than 0.05% by weight, optical density is insufficient and when the amount is more than 20% by weight, the viscosity of the ink become high and stability when discharging from the ink jet head tends to become poor.

In both the transparent ink and the color ink, an auxiliary such as a sensitizer can also be added to advance the initiation reaction of the photoinitiator in an amount by which the effects of the present invention are not lost.

The transparent ink and color ink of the present invention are obtained by mixing the above components, dispersing and then filtering.

The materials can be mixed in any order but mixing is preferably conducted rapidly. When a coloring agent is used, stirring is conducted more thoroughly so that the mixture does not become inhomogeneous.

Methods using a roll mill, ball mill, colloid mill, jet mill or bead mill can be employed as the dispersion method.

Also, when necessary, additives such as a dispersant, heat stabilizer, antioxidant, antiseptic, defoaming agent and penetrating agent can be added to the ultraviolet ray curable ink composition in an amount by which the effects of the present invention are not lost.

The printing apparatus is described below.

The ultraviolet ray curable ink of the present invention is applied by an ink jet method. Examples of the ink jet method are continuous methods such as the charged modulation method, micro dot method and ink mist method and on-demand methods such as the stemme method, pulse jet method, Bubble Jet™ method and electrostatic suction method.

Figure 3:
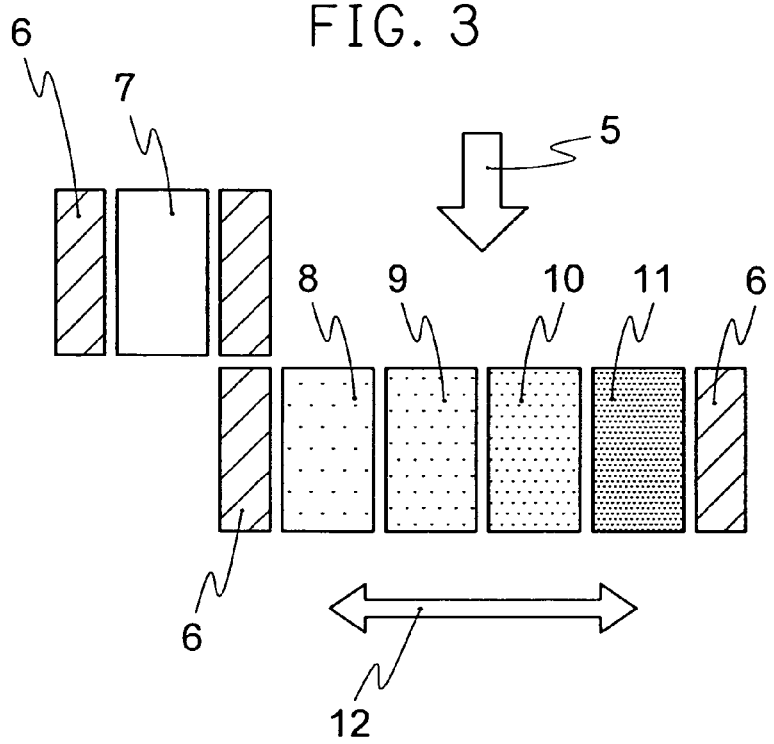
FIG. 3 is a schematic view of the two-stage printing method.
Figure 4:
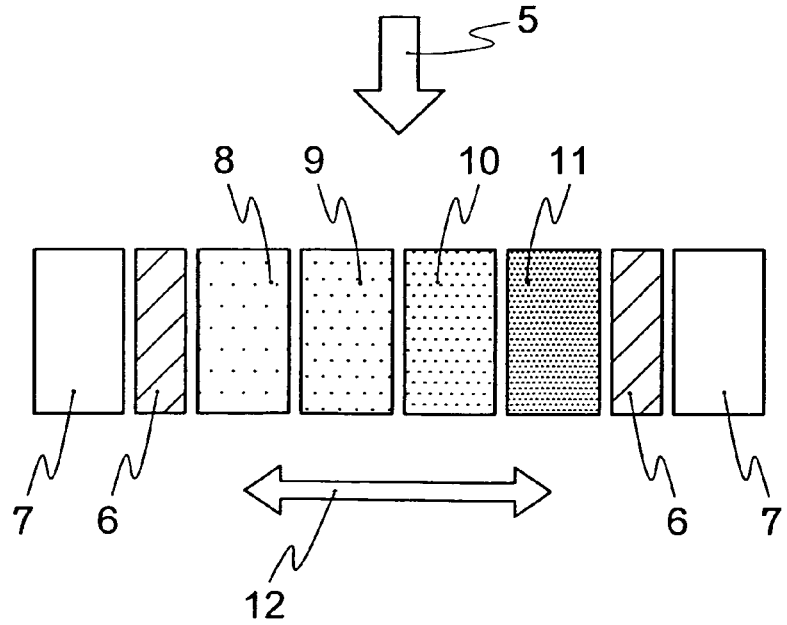
FIG. 4 is a schematic view of the linear printing method.

The ink jet printing apparatus of the present invention is equipped with a two-stage head (FIG. 3) or a linear head (FIG. 4).

As shown in FIG. 3, a two-stage head refers to a head comprising a front head equipped with ultraviolet ray exposing means 6 and transparent ink head 7 and a rear head equipped with ultraviolet ray exposing means 6 and color ink heads 8 to 11. In this way, by placing an ultraviolet ray exposing means on both sides of transparent ink head 7 and each of color ink heads 8 to 11, the transparent ink and the color ink can be exposed by ultraviolet rays immediately after being applied and excessive permeation of the ink can be prevented. Also, according to the present composition, in the case that many ink heads are installed to increase the types of color ink, the size of the printing apparatus in the driving direction of the head can be kept small. Also, the driving speed of transparent ink head 7 and the driving speeds of color ink heads 8 to 11 can be set to different driving speeds. The ultraviolet ray exposing means 6 can be located at a position other than that shown in FIG. 3 and is not limited as long as the above effects can be obtained. For example, ultraviolet ray exposing means 6 can be placed accordingly between the color ink heads.

A linear head refers to a head equipped with ultraviolet ray exposing means 6, transparent ink head 7 and color ink heads 8 to 11 in a straight line as shown in FIG. 4. In this way, by placing ultraviolet ray exposing means 6 and transparent ink head 7 on each side of color ink heads 8 to 11, the transparent ink and the color ink can be exposed by ultraviolet rays immediately after being applied and excessive permeation of the ink can be prevented. Also, according to the present composition, there is the advantage that driving of the ink head can be conducted in one operation, instead of one operation each for transparent ink and color ink. The ultraviolet ray exposing means 6 can be located at a position other than that shown in FIG. 4 and is not limited as long as the above effects can be obtained. For example, ultraviolet ray exposing means 6 can be placed accordingly between the color ink heads or on both sides of transparent ink head 7.

In the process for printing images using the ink jet printing apparatus of the present invention, first, transparent ink is applied in the shape of the image by transparent ink head 7 and immediately cured by ultraviolet ray exposing means 6. Then, the image is printed by color ink heads 8 to 11 and cured by ultraviolet ray exposing means 6 to obtain printed matter.

By using the ink jet printing apparatus of the present invention having a two-stage head or a linear head, there is the advantage that a sequence of steps can be conducted with one apparatus. Furthermore, because the necessary amount of ink can be accurately applied to specific areas, the transparent ink does not need to be applied to the entire surface and cost can be kept low.

The viscosity of the ink when discharged is preferably 1 to 100 cps, more preferably 5 to 50 cps. When the viscosity is less than 1 cps, actual production is difficult. When the viscosity is more than 100 cps, discharging ink from the ink jet head tends to become difficult.

The ink jet printing apparatus of the present invention is preferably equipped with a heating means in the head. Installing a heating means to the head is preferable as the viscosity of the ink can be lowered and furthermore, the ink can be discharged while maintaining the temperature.

The heating temperature is within the range of room temperature to 150° C., more preferably 30 to 70° C. When the temperature is higher than 150° C., the reactive oligomer and reactive diluent in the ink may be cured.

The printing conditions and ultraviolet ray exposing conditions can be conditions used in normal printing and are not particularly limited.

Hereinafter, the present invention is explained in detail based on Examples, but not limited thereto.

<Printing Conditions>
A. Nozzle diameter: 70 μm
B. Applied voltage: 50 V
C. Pulse width: 20 μs
D. Driving Frequency: 1 kHz
E. Resolution: 180 dpi <Ultraviolet Ray Exposure Conditions>
a) Lamp: metal halide lamp
b) Voltage: 120 W/cm
c) Exposure time: 1 second
d) Exposure height: 10 cm <Recording Medium>
100% polyester fabric (plain stitch) was used as the recording medium.

Figures 1A, 1B, 1C:
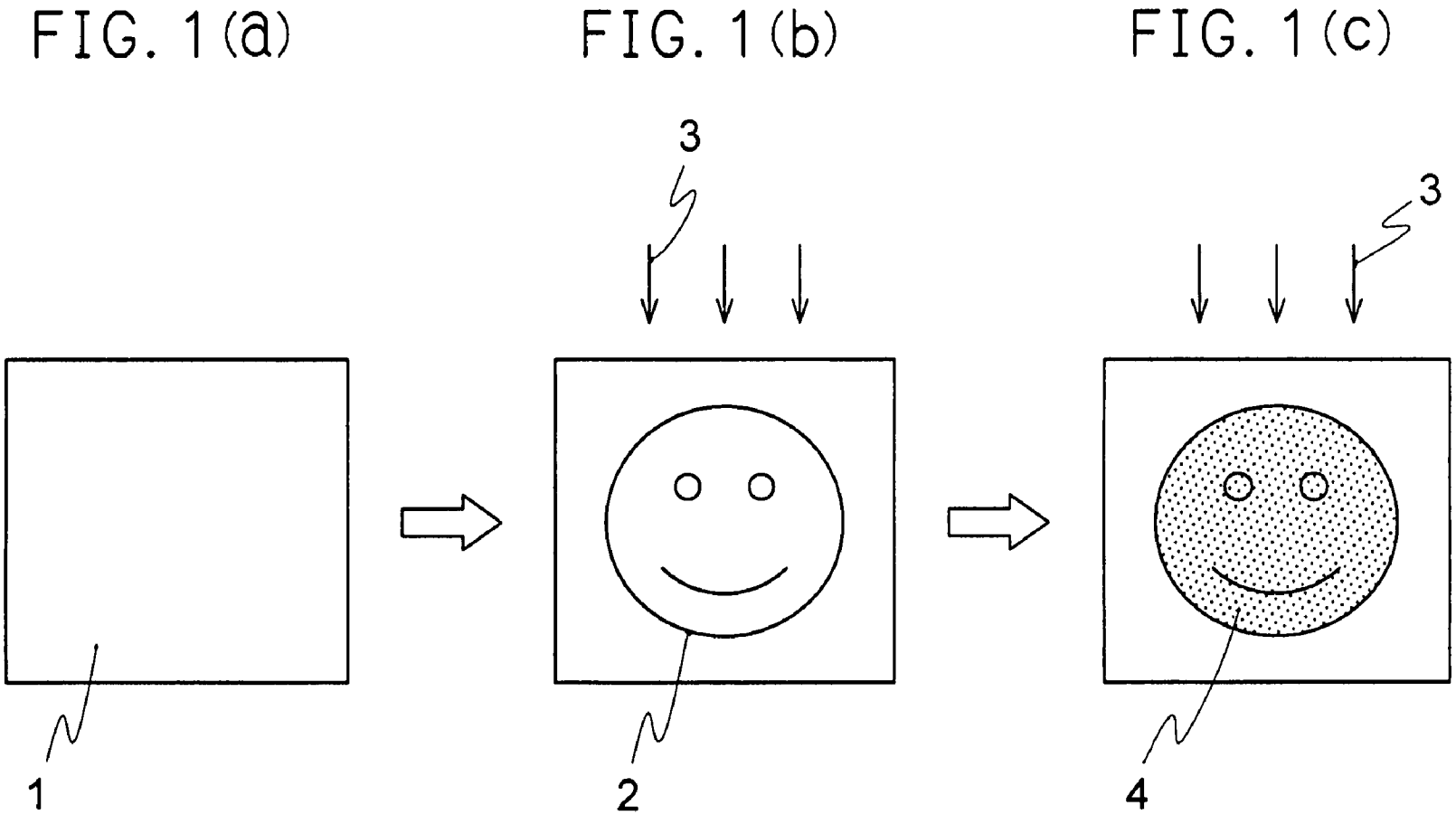
FIG. 1 is a schematic view of the present invention.
Figures 2A, 2B, 2C:
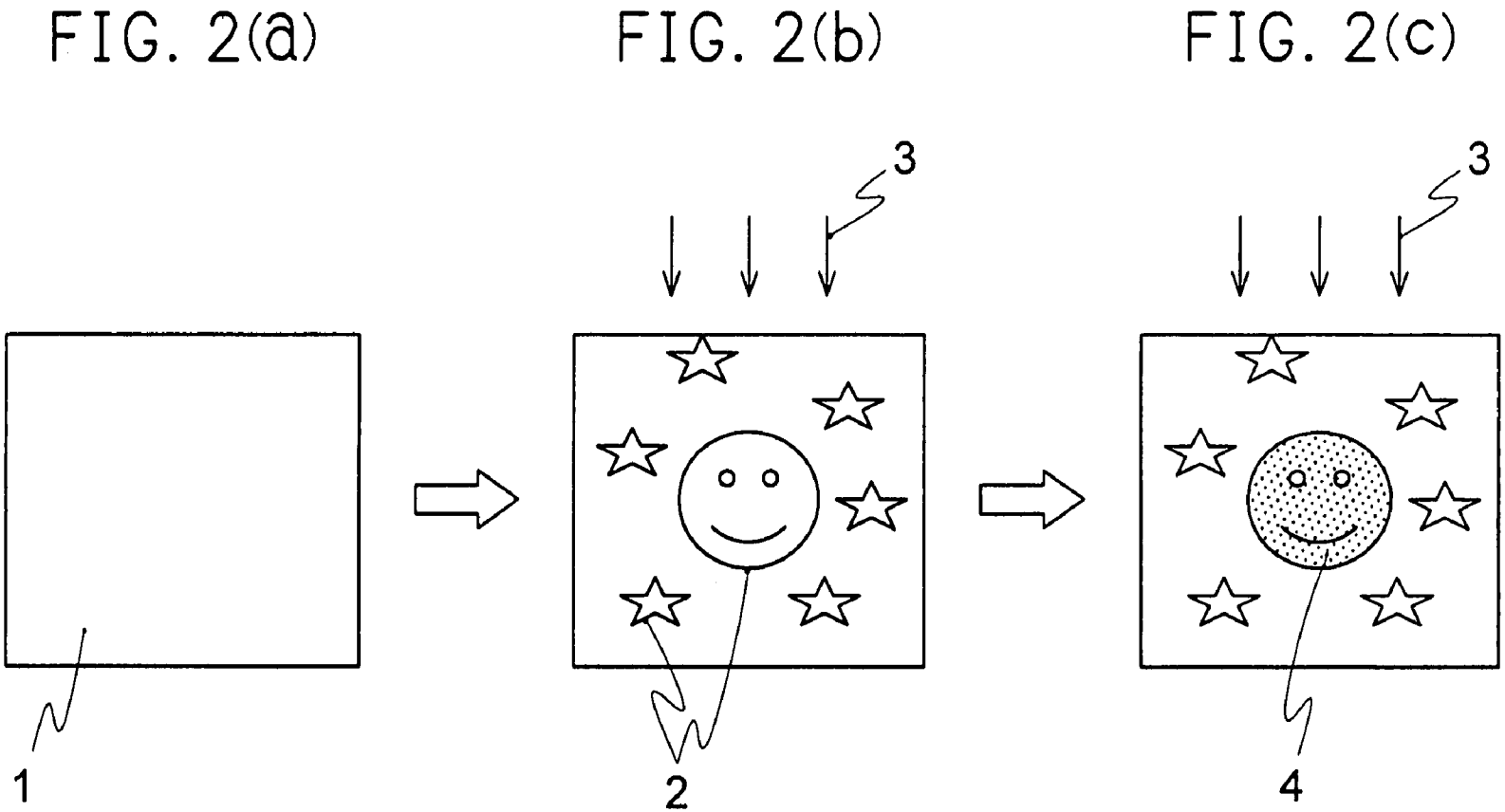
FIG. 2 is a schematic view of the present invention.

<Printed Image>
As shown in FIGS. 1 and 2, two types of images were prepared and evaluated.

The process shown in FIG. 1 is a process for obtaining printed matter, in which transparent ink is applied and cured by exposing ultraviolet rays and then color ink is applied over the transparent ink and cured by exposing ultraviolet rays.

The process shown in FIG. 2 is a process for obtaining printed matter, in which the step of applying transparent ink along a three-dimensional image (areas where lines are written are the protruded areas) and then curing by exposing ultraviolet rays is repeated several times to form a three-dimensional shape and then color ink is applied only to the center smiley face and cured by exposing ultraviolet rays. In the obtained printed matter, only the center smiley face is a colored image and the stars become colorless images with a modified surface texture.

<Evaluation>

Bleeding: Thin lines (1 mm) and edge of the pattern were visually observed.

○: Sharp image was formed

Δ: Some bleeding was observed x: Bleeding was observed overall

Optical density: Optical density was measured with a reflection density measuring instrument (Macbeth RD 918). The higher the OD value (reflection density) is the higher the optical density.

○: OD value of 1.4 or more

Δ: OD value of at least 1.0 to 1.4 x: OD value of 1.0 or less

Design: Design was visually observed.

○: Excellent in design, as optical density and saturation of the color image are excellent and a colorless image with modified surface texture is formed in addition to the color image Δ: Optical density and saturation of the color image are excellent x: Poor in design, as optical density and saturation of the color image are poor

EXAMPLE 1

(Preparation of Transparent Ink)

20 parts by weight of Ebecryl 270 as a reactive oligomer (urethane acrylate (difunctional), available from Daicel UCB Co., Ltd.), 75 parts by weight of SR-9003 as a reactive diluent (propoxylated neopentylglycol diacrylate (difunctional), available from Sartomer Company) and 5 parts by weight of Irgacure 2959 as a photoinitiator (1-[4-(hydroxyethoxy)-phenyl]-2-hydroxy-2-methyl-1-propane-1-one, acetophenone type, available from Ciba Specialty Chemicals K.K.) were mixed and thoroughly stirred. Then, impurities were removed by filtration to prepare colorless transparent ink (viscosity: 13.1 mPa·s/60° C.).

(Preparation of Color Ink)

20 parts by weight of Ebecryl 270 as a reactive oligomer (urethane acrylate (difunctional), available from Daicel UCB Co., Ltd.), 73.7 parts by weight of SR-9003 as a reactive diluent (propoxylated neopentyl glycol diacrylate (difunctional), available from Sartomer Company), 1 part by weight of HOSTAPERM PINK E-02 as a coloring agent (quinacridone red, available from Clariant Japan K.K.), 0.3 part by weight of Flowlen DOPA-33 as a dispersant (modified acrylic copolymer available from Kyoeisha Chemical Co, Ltd.) and 5 parts by weight of Irgacure 2959 as a photoinitiator (1-[4-(hydroxyethoxy)-phenyl]-2-hydroxy-2-methyl-1-propane-1-one, acetophenone-type, available from Ciba Specialty Chemicals K.K.) were mixed and dispersed by the bead mill method. Then, impurities were removed by filtration to prepare magenta ultraviolet ray curable ink (viscosity: 14.1 mPa·s/60° C.).

In the same way, yellow color ink [PV Fast Yellow H2G as a coloring agent, benzoimidazorone (azo-type), available from Clariant Japan K.K.] (viscosity: 14.9 mPa·s/60° C.), cyan color ink [Toner Cyan BG as a coloring agent, phthalocyanine, available from Clariant Japan K.K.] (viscosity: 13.3 mPa·s/60° C.) and black color ink [NiPex 180IQ, carbon black, available from Degussa Co.] (viscosity: 13.5 mPa·s/60° C.) were prepared.

(Printing Method)

As the process for applying ink to the recording medium, the process of heating ink in a heating means and then printing images using a two-stage head was used (heating temperature 60° C.). The amount of transparent ink applied was 40 g/m$^2$. The amount of color ink applied was 20 g/m$^2$. The results are shown in Table 1.

EXAMPLE 2

The experiment was conducted in the same manner as in Example 1 except that images were printed using a linear head. The amount of the transparent ink applied was 40 g/m$^2$. The amount of color ink applied was 20 g/m$^2$. The results are shown in Table 1.

EXAMPLE 3

(Preparation of Transparent Ink)

5 parts by weight of Ebecryl 270 as a reactive oligomer (urethane acrylate (difunctional), available from Daicel UCB Co., Ltd.), 90 parts by weight of SR-9003 as a reactive diluent (propoxylated neopentylglycol diacrylate (difunctional), available from Sartomer Company) and 5 parts by weight of Irgacure 2959 as a photoinitiator (1-[4-(hydroxyethoxy)-phenyl]-2-hydroxy-2-methyl-1-propane-1-one, acetophenone-type, available from Ciba Specialty Chemicals K.K.) were mixed and thoroughly stirred. Then, impurities were removed by filtration to prepare colorless transparent ink (viscosity: 22.1 mPa·s/25° C.).

(Preparation of Color Ink)

5 parts by weight of Ebecryl 270 as a reactive oligomer (urethane acrylate (difunctional), available from Daicel UCB Co., Ltd.), 88.7 parts by weight of SR-9003 as a reactive diluent (propoxylated neopentylglycol diacrylate (difunctional), available from Sartomer Company), 1 part by weight of HOSTAPERM PINK E-02 as a coloring agent (quinacridone red, available from Clariant Japan K.K.), 0.3 part by weight of Flowlen DOPA-33 as a dispersant (modified acrylic copolymer available from Kyoeisha Chemical Co, Ltd.) and 5 parts by weight of Irgacure 2959 as a photoinitiator (1-[4-(hydroxyethoxy)-phenyl]-2-hydroxy-2-methyl-1-propane-1-one, acetophenone-type, available from Ciba Specialty Chemicals K.K.) were mixed and dispersed by the bead mill method. Then, impurities were removed by filtration to prepare magenta ultraviolet ray curable ink (viscosity: 23.5 mPa·s/25° C.).

In the same way, yellow color ink [PV Fast Yellow H2G as a coloring agent, benzoimidazorone (azo-type), available from Clariant Japan K.K.] (viscosity: 23.1 mPa·s/25° C.), cyan color ink [Toner Cyan BG as a coloring agent, phthalocyanine, available from Clariant Japan K.K.] (viscosity: 22.9 mPa·s/25° C.) and black color ink [NiPex 180IQ as a coloring agent, carbon black, available from Degussa Co.] (viscosity: 23.3 mPa·s/25° C.) were prepared.

(Printing Method)

Images were printed using a two-stage head in the same manner as in Example 1, except that the transparent ink and color ink were discharged without heating. The amount of transparent ink applied was 40 g/m$^2$. The amount of color ink applied was 20 g/m$^2$. The results are shown in Table 1.

COMPARATIVE EXAMPLE 1

(Preparation of Color Ink)

Yellow, magenta, cyan and black color inks were prepared in the same manner as in Example 1.

(Printing Method)

To apply ink to the recording medium and cure the ink, a heatable ink jet printer head and an ultraviolet ray lamp were used. Printed matter was obtained by discharging color ink directly onto the cloth and then curing (heating temperature 60° C.). The results are shown in Table 1.

TABLE 1

| | Bleeding | Optical Density | Design |
|---|---|---|---|
| Ex. 1 | ○ | ○ | ○ |
| Ex. 2 | ○ | ○ | ○ |
| Ex. 3 | ○ | ○ | ○ |
| Com. Ex. 1 | X | Δ | Δ |

As evident from Table 1, the ink jet printed matter of Examples 1 to 3 prepared by the process of the present invention were sharp unblurred images and with respect to the optical density measured using a reflection density measuring instrument (Macbeth RD 918), a high optical density of OD value of at least 1.4 was obtained for each color. Also, printed matter having excellent design was obtained.

On the other hand, the ink jet printed matter of Comparative Example 1, which was not prepared by the process of the present invention, was blurred and optical density was insufficient.

In this way, according to the present invention, printed matter having excellent design can be prepared and unblurred ink jet printed images having high optical density can be obtained.

What is claimed is:

1. A process for ink jet printing on a cloth using ultraviolet ray curable ink, which comprises the steps of forming a three-dimensional pattern on the cloth by repeating the step of applying a transparent ultraviolet ray curable ink and then curing by ultraviolet rays; and applying an ultraviolet ray curable ink containing a coloring component on the three-dimensional pattern to form a three-dimensional image, wherein said transparent ultraviolet ray curable ink and said ultraviolet ray curable ink containing a coloring component comprises a reactive oligomer, a reactive diluent and a photoinitiator;

said reactive oligomer being contained in an amount of 1 to 70% by weight in said transparent ultraviolet ray curable ink and in an amount of 1 to 60% by weight in said ultraviolet ray curable ink containing a coloring component.

2. The process for ink jet printing of claim 1, wherein said transparent ultraviolet ray curable ink and said ultraviolet ray curable ink containing a coloring component are heated by a heating means and then discharged.

* * * * *